United States Patent [19]

Imai et al.

[11] 3,944,193

[45] Mar. 16, 1976

[54] METHOD AND APPARATUS FOR FORMING BY VIBRATION A REFRACTORY LINING OF A CONTAINER FOR A MOLTEN METAL

[75] Inventors: Hiroyuki Imai; Rikuo Kaharu, both of Himeji, Japan

[73] Assignee: Nippon Steel Corporation, Tokyo, Japan

[22] Filed: June 5, 1974

[21] Appl. No.: 476,451

Related U.S. Application Data

[62] Division of Ser. No. 389,633, Aug. 21, 1973.

[30] Foreign Application Priority Data

| | | |
|---|---|---|
| Aug. 26, 1972 | Japan | 47-85555 |
| Sept. 2, 1972 | Japan | 47-88056 |
| Dec. 16, 1972 | Japan | 47-126550 |

[52] U.S. Cl. ..... 266/1 R; 266/43; 164/33; 164/39

[51] Int. Cl.[2] ..... B22C 9/12; B22C 15/10

[58] Field of Search ..... 264/30, 268, 269; 425/425, 425/427, 203, 207, 432; 164/33, 39, 196, 197, 203, 204; 141/67, 71, 73; 222/161, 198, 196; 266/43

[56] References Cited

UNITED STATES PATENTS

| | | | |
|---|---|---|---|
| 1,944,989 | 1/1934 | Lux | 425/432 X |
| 2,559,356 | 7/1951 | Hedges | 141/67 X |
| 2,605,533 | 8/1952 | Hirsh | 425/432 X |
| 2,942,319 | 6/1960 | Anthony | 264/269 X |
| 3,151,200 | 9/1964 | Spencer | 266/43 |
| 3,439,734 | 4/1969 | Eastwood | 164/33 |
| 3,492,395 | 1/1970 | Breitfuss | 425/432 X |
| 3,625,278 | 12/1971 | Bishop | 164/201 |

*Primary Examiner*—Francis S. Husar
*Assistant Examiner*—Carl Rowold
*Attorney, Agent, or Firm*—Watson Leavenworth Kelton & Taggart

[57] ABSTRACT

Apparatus for forming a refractory lining is disclosed which comprises a molding box for forming a refractory lining of an inner wall of a container for molten metal made up of an irregularly shaped mass of refractory material which has been vibrated and given thixotropic fluidity. The molding box is positioned within the container having at least one hole pierced in its bottom and means are provided for opening and closing the hole and vibrating the molding box, with the hole being connected with a vessel for vibrating the refractory material.

5 Claims, 6 Drawing Figures

METHOD AND APPARATUS FOR FORMING BY VIBRATION A REFRACTORY LINING OF A CONTAINER FOR A MOLTEN METAL

CROSS REFERENCE TO RELATED APPLICATION

This application is a division of copending U.S. patent application Ser. No. 389,633, filed Aug. 21, 1973.

BACKGROUND OF THE INVENTION

1. Field of the Invention

This invention belongs to the field of refractory lined containers intended to receive molten metals of high temperatures.

2. Description of the Prior Art

In an attempt to provide a container for a molten metal with a deformable refractory lining, there have been proposed a method for lining said container with an indefinite refractory material and a method for repairing only a part thereof which has been ruined by a molten metal at a high temperature.

The term "container" as used herein defines a container for a molten metal or a container to receive and transport molten metal at high temperatures such as molten steel, etc. for the purpose of treating or reacting said metal. Examples of such a container includes ladles, runners, tundishes, vacuum degassing containers and other high temperature treating furnaces or containers and the like.

The term "an indefinite refractory material" as used herein defines a refractory material in a powdery, pasty, slurry or like refractory material form which is deformable when applied, as contrasted to a solid brick or the like having a definite shape.

As the former method, a stamping or ramming process and a sand-slinger process are known. As the latter method, a spraying or gunning process is known. In the stamping or ramming process, however, there is a disadvantage that, when an air rammer is used to ram the bottom lining and also to ram up the side lining layer by layer between the side wall of the container and that of the core, the lining thus produced has different densities at different places, especially in forming the bottom lining and that it takes a considerable time to complete the lining. In the sand slinger process, which is intended to project the indefinite refractory material at high speed so as to replace the old lining thereby, there is also a disadvantage in that the lining thus produced has different densities at different places, and that said densities are comparatively low.

In the spraying process, a certain degree of effectiveness can be expected in the case of filling a partially ruined void. However, there is still a disadvantage that in case of spraying the material in the overall side wall substantially uniformly, there is a limit in the thickness of the lining because it has a comparatively higher water content and that the lining thus produced has low density.

It is therefore an object of the invention to overcome the disadvantages incidental to the prior art.

It is another object of the invention to provide an improved method and apparatus for lining a container for a molten metal, said lining being effected under the same conditions whether it is to be an entire replacement of a lining or a partial repair of a lining.

SUMMARY OF THE INVENTION

This invention relates to a method and apparatus for providing a container for a molten metal with a lining of an indefinite refractory material by means of vibration.

In accordance with this invention, there is provided a method for forming by vibration a refractory lining of a container for molten metal which comprises vibrating an indefinite refractory material to obtain a thixotropically fluidized condition of the refractory material, said refractory material having thixotropy with a suitably adjusted water content, causing said refractory material under said fluidized condition to flow from the bottom of a molding box or frame mounted inside said container, and filling a gap formed between said container and said molding box with said refractory material while vibrating said molding box. In accordance with this invention, there is also provided a molding box adapted for use in effecting the above-mentioned method, which molding box has a hole pierced through the bottom thereof to define a flow passage for outlet of refractory material from the molding box, there being means provided for opening and closing said passage, said flow passage communicating with a vessel 4 vibrating an indefinite refractory material, and a vibrating means for vibrating said box. In accordance with this invention, there is still further provided an apparatus adapted for use in effecting the above-mentioned method which comprises said molding box for vibrating an indefinite refractory material, means for opening and closing the flow passage therein, a vessel for vibrating the indefinite refractory material, a mold box supporting member fixed indefinite refractory material, trunnion members fixed on said molding box, slidable stands mounted on a base, said stands being adjustable with respect to their positions in the horizontal direction and there further being means to adjust positioning of the molding box in a vertical direction, and supports fixed on said base, said supports detachably fixing said molding box supporting member.

In the practice of this invention, the thixotropy of an indefinite refractory material is utilized very effectively. Thus an indefinite refractory material having thixotropy such as one composed of powders having particle size of less than about 10 mm added with a suitable amount or not more than 10% of water, and preferably a small amount of water glass is used with vibration. The term "thixotropy" as used herein defines a property that results when a mechanical vibration is given to an indefinite refractory material of a certain chemical composition having a low water content, the indefinite refractory material becoming fluidized as a whole despite its low water content while bubbles between the particles of the material are degassed to produce a slurry or fluidized refractory material having high density and low porosity, and when the vibration is stopped, it becomes solidified immediately, losing its fluidity. That is, the term thixotropy is a property that the material changes isothermally and reversibly from the fluidized condition to the solidified condition and vice versa depending upon the start and stop of the vibration. Usually, as the amount of water added to the indefinite refractory material is reduced, the porosity of the material after lining is reduced while the anticorrosion property against the molten metal is increased proportionally. However, the relation between the thixotropy and the water content of the material is such that the thixotropy disappears when the water content becomes too much or too small. Thus, when it is to small, for example, less than about 3%, the material does not become fluidized but small aggregates having great porosity are found since the water does not fully extend over the surface of each particle of the material. On the other hand, when the water content is too much, for example, more than about 10%, the material becomes fluidized very easily even by means of mixing in the usual mixer, but the porosity becomes high after lining, the time for removing the molding box followed by drying becomes long, and the material tends to be contracted and cracked when dried.

The above-stated relation between the thixotropy of the indefinite refractory material and the amount of water added thereto varies with the composition, the particle size, the particle shape and the particle viscosity of the material and so on. The inventors' experience shows that, in case of an ordinary indefinite refractory material used for the abovementioned container for a molten metal, a suitable water content to be added to the material may be between about 3% and about 10%, and most preferably, between about 5% and about 7%. The refractory lining thus produced in this invention shows porosity as low as 20% or less.

In this invention, as the means to vibrate and mix the material having its water content adjusted to a suitable amount or between about 3% and about 10%, there have been proposed a method for providing a molding box with a vessel and vibrating and mixing the material in said vessel and a method for vibrating and mixing the material in a vessel mounted apart from the molding box and passing the material thus fluidized to a reservoir mounted inside the molding box. In the latter method, it is necessary to provide a step of transporting the fluidized material to the reservoir inside the molding box, and in this case it is desirable to also vibrate the material being transported so as to maintain the thixotropy of the material.

As the means to impart vibration to the above vessel, there are means to attach a vibrating machine to either the vessel or the molding box, or to impart vibration through a certain medium or vibration transmitting member to said vessel or said molding box. As the vibrating machine, either one capable of vibrating at high cycle such as 6000 or more vibrations per minute (VPm), or one capable of vibrating at low cycle such as 3600 or less VPm may be used depending upon the quality, property or amount of the refractory material used. Of course, other vibrating machines having various vibration cycles may be used singly or in combination.

In vibrating the indefinite refractory material, the vibrating machine generally generates a comparatively large noise, higher level of which results in an adverse effect upon the working environment. In this invention however, a vessel for vibrating the material which is mounted either inside the molding box or in a place apart from the molding box may be used. Accordingly, in the former case, the molding box may serve as a sound proof wall, while in the latter case, the vessel can be set inside a sealed or tightly closed chamber whereby the noise problem can be obviated.

In order to obtain the fluidized refractory material of high density and low porosity with a better result after said material is vibrated and mixed, one method is that the vessel for vibrating and mixing the material can be put under reduced pressure whereby the degassing of the material can be accelerated during the vibration.

Another method is that a weight having a plurality of bores therethrough is put on the material inside the vessel whereby the vibration of the material may be conducted under load or weight to accelerate degassing. By means of these methods, the fluidized material can be degassed in a short time to thereby produce a fluidized refractory material of high density.

The inventors' experiments show that the vibration of an indefinite refractory material adjusted to a water content of 3 to 10% may produce a slurry of refractory material of high density with very low porosity such as 9 to 12%.

In the practice of this invention, the fluidized refractory material is allowed to flow from the bottom of the molding box mounted inside the container and to fill, while vibrated, the gap formed between the container and the molding box.

As stated above, the molding box may be provided with either a vessel for vibrating the material or a reservoir. The a passage is provided in the bottom of the vessel or reservoir and can be selectively interconnected with a passage in the bottom of the molding box. The bottom of the vessel or the reservoir is kept closed while the material is vibrated or received. When the material is to be caused to flow to fill the gap between the container and the molding box, the passage in the molding box is opened, through which the fluidized material is supplied. Since the filling of the gap resists the gravity of the material, it is preferable to keep the vessel or reservoir in the pressurized condition. Experiments show that the preferable pressure to be imparted is 2 to 3 kg/cm$^2$ when the material is filled up to 3 m.

In order to keep the vessel or reservoir in the pressurized condition so as to fill the fluidized material under pressure, it is desirable to supply a compressed fluid such as compressed air to said vessel or reservoir so as to impart the pressure from above the material or to use a mechanical means such as a piston so as to push down the material.

In the conventional method where it is desired to repair only a ruined part of the lining wall of the container, the thickness of the remaining lining which has not been spoiled by a molten metal is greater in the upper portion than in the lower portion since the upper portion of the lining wall has not come into contact with the molten metal and thus has not been ruined by the molten metal very much. Accordingly, when in this case a molding box is mounted inside the container, the gap between the remaining lining of the wall of the container and the side of the molding box is greater in the lower part but smaller or even none in the upper part. Under these conditions, it is very difficult to fill the gap with the fluidized material from above the gap.

In this invention, however, the material is allowed to fill the gap from the bottom of the molding box, preferably in the pressurized condition, whereby the gap may be filled from the greater part to the smaller part very easily.

Also the filling is effected in this invention from the lower gap to the upper gap so that the air intervening in the gap may be pushed up from the lower part, whereby there is no bubble or void formed in the material.

When the material is filled in the gap, the molding box is vibrated. As for a source for the vibration of the box, the vibrating machine for the vessel or the reservoir can be utilized also for the molding box. Alternatively, another vibrating machine can be provided for vibrating the molding box exclusively.

In the vibration of the molding box, when it is too strong, a segregation may occur in the material filled in the gap, which results in an adverse effect upon the lining. The vibration of the molding box can be controlled by the structure or rigidity of the molding box and the number of the vibrating machines used. As set forth hereinabove, the fluidized refractory material is allowed to flow from the bottom of the molding box while vibrated and to fill the gap between the container and the molding box, whereby the material is elevated through the gap. When the filling is completed up to a predetermined position, the supply of the material is stopped and the vibration of the molding box is ceased.

Then the refractory material under slurry or fluidized condition lined over the internal surface of the container is solidified owing to its thixotropy, whereby a uniform and integral lining of low porosity and high density may be produced. Soon after the cessation of vibration of the molding box, the molding box is removed from the container.

Consequently, in this invention, the amount of water added to the material is made minimum owing to the vibration mixing based upon the thixotropy, and yet a fully fluidized material can be obtained. This fluidized material can then be mixed integrally and densely with low porosity because it is filled in the gap from the bottom of the molding box and preferably in the pressurized condition. Thus the lining produced shows an excellent resistance against attack by a molten metal. Furthermore, because of utilization of thixotropy and the low water content, the forming of the lining is simplified, the time for drying after molding is reduced, and cracking seldom occurs at the time of drying.

Moreover, in the practice of the invention, very economical use of material is made possible since, when it is desired to repair the lining, there is no need of peeling off the entire lining, and all that is necessary is to remove the slag attached to the ruined part keeping the other parts intact. The preferable embodiment of the apparatus of this invention is described below with reference to the drawing.

BRIEF DESCRIPTION OF THE DRAWING:

In FIGS. 1 and 2, numeral 1 is a container to be lined and 2 is a remaining lining. This container may be of different shape, size and lining thickness depending upon its use, of course. When a molding box 3 is mounted inside the container, a gap 4 is formed between the molding box 3 and the container 1. For the purpose of lining the entire internal surface of the container 1, the molding box is composed of the side wall 5 and the bottom wall 6.

Figure 1:
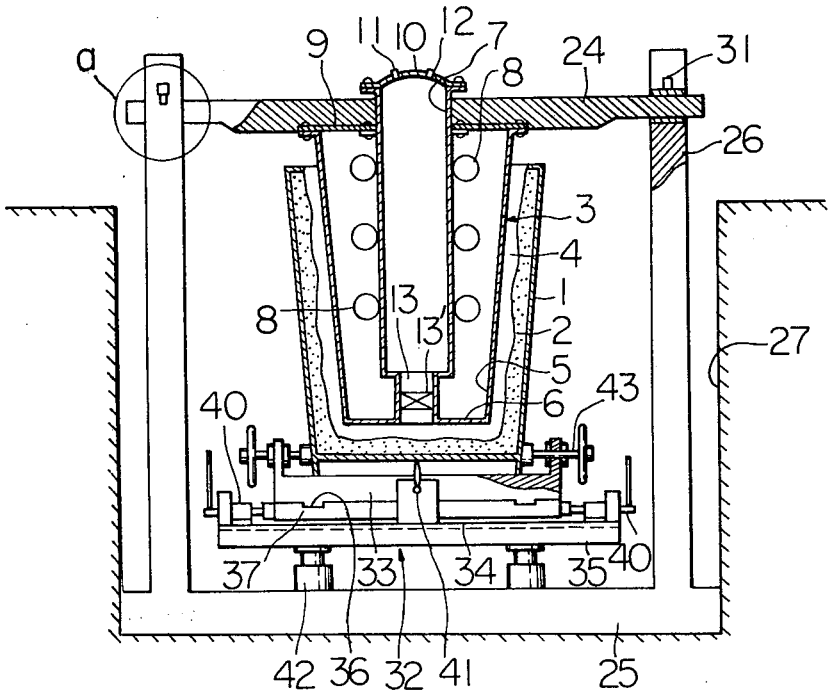
FIG. 1 is a sectional elevational view illustrating one example of the apparatus of this invention.

A closed vessel 7 may be mounted inside the box 3, which vessel is intended to vibrate the indefinite material charged therein so as to keep it under fluidized condition. Alternatively, the vessel may serve as a reservoir to receive the fluidized material which has been vibrated in another place.

On the side of the vessel 7, a plurality of vibrating machines 8 can be attached. They can supply vibration to the vessel 7 and the box 3 as desired. In order to vibrate the molding box 3, some ribs (not shown) may be fixed between the box 3 and the vessel 7 at several places so as to connect them such that the vibration of the vibrating machines 8 attached to the vessel 7 can be transmitted to the box 3. Alternatively, another vibrating machine can be used exclusively for the molding box 3.

The power of vibration for the vessel 7 and the box 3 can be adjusted depending upon the number of machines 8 and the structure or rigidity of the vessel 7 and the box 3.

The numeral 9 shows a sound proof cover for the box 3, which serves to confine the noise generated from the machines 8 into the tightly closed box 3, giving no adverse effect upon the surrounding environment. On the upper portion of the vessel 7 is provided a closure lid 10 which can be opened and closed so as to seal the vessel 7 and to charge the vessel with indefinite refractory material. The lid 10 may be provided with an exhaust pipe 11 to reduce the pressure inside the vessel 7, the end of which is connected to a proper pressure reduction device (not shown) such as a vacuum pump, etc. The reduction of pressure inside the vessel 7 will accelerate degassing of air or other gas intervening in the fluidized material vibrated inside the vessel 7, and thus will produce a material of higher density.

Moreover, it is preferable to provide the vessel 7 with a means to connect the vessel with a source of pressure which promotes the flow of the material through a passage 13 of the bottom of the box 3 and the filling of the gap 4 with the material.

Figure 4:
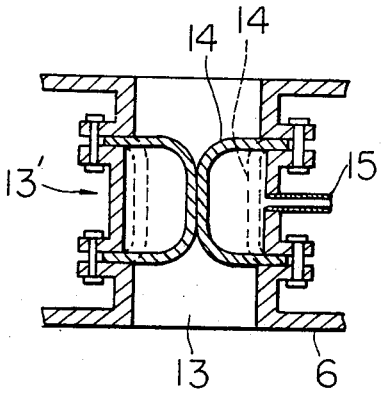
FIG. 4 is a sectional enlarged view illustrating the bottom of the molding box of FIG. 1.
Figure 5:
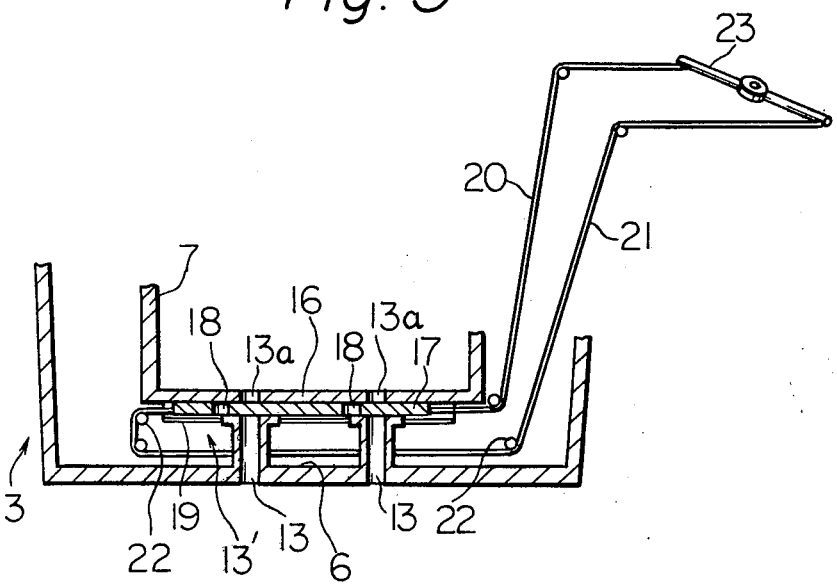
FIG. 5 is a sectional view of another embodiment of FIG. 4.
Figure 6:
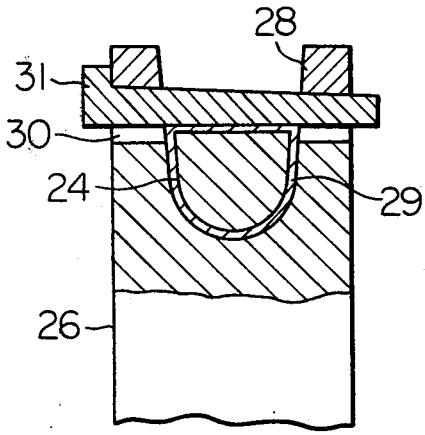
FIG. 6 is an enlarged view of part *a* of FIG. 1.

As an example of such means, a pressure pipe 12 is shown in the lid 10. One end of this pipe 12 is connected to a source of pressure (not shown) such as compressed air. In this way the inside of the vessel 7 is pressurized, whereby the fluidized material is caused to flow from the passageway 13. The bottom of the vessel 7 is provided with a hole 13*a* which can be interconnected with, or in this case it is aligned with, the passage 13 of the bottom of the molding box 3. The molding box is provided with means 13' for opening and closing passage 13 so as to either pass or stop the flow of material from the box to the gap. One such example is shown in FIG. 4, in which a pair of expansible members 14 are attached to the wall of the passage 13. When compressed air is supplied through a pipe 15 to the member 14, it is allowed to expand and close the path of the passage 13. When the compressed air is released, the member 14 is caused to shrink as shown with dotted lines and open the path of the passage 13. Another modification of the means 13' is shown in FIG. 5 in which one or more passages 13 are provided between the bottom wall 16 of the vessel 7 and the bottom 6 of the molding box 3 and a transverse plate 17 supported by a guide 19 is provided so as to cross over said passages 13. The plate 17 has the same number of openings 18 as that of the passages 13 and, on both ends thereof, one end of wires 20 and 21 are fixed respectively. The wires are extended via pulleys 22 over the molding box 3 and the other end of the wires 20 and 21 are fixed to both ends of a handle 23. When the handle 23 is operated, the plate 17 is caused to move sliding to right and left as required to register passages 13 with the openings 18 so as to interconnect the path therethrough or close off the flow path through passages 13.

In the operation of the above apparatus, the lid 10 is opened, a predetermined amount of indefinite refractory material having an adjusted water content is then charged into the vessel 7 and the lid 10 is tightly closed. Thereafter the vibrating machine 8 is operated to vibrate and mix the material. During this time, the vessel is placed under reduced pressure by way of exhaust pipe 11.

When a desirable fluidized refractory material is obtained, the pressure reduction inside the vessel is stopped. Then the passage 13 is opened by operating means 13′ and also the pressurized air is admitted through pipe 12 so that the fluidized material is caused to flow through the passages 13, with the material thus discharged filling the gap 4 formed between the box and the container 1. After the gap is filled to a predetermined height, the vibrating machine 8 is caused to stop. The fluidized material filled in the gap 4 then solidifies owing to its thixotropy.

In order to fulfil the above operation, it is necessary to set and fix the molding box 3 inside the container 1 at a predetermined position. In this case it is necessary to select the molding box 3 having a size matching with that of the container 1 to be lined, determine its position in the vertical and horizontal direction, and fix the same therein.

Figure 2:
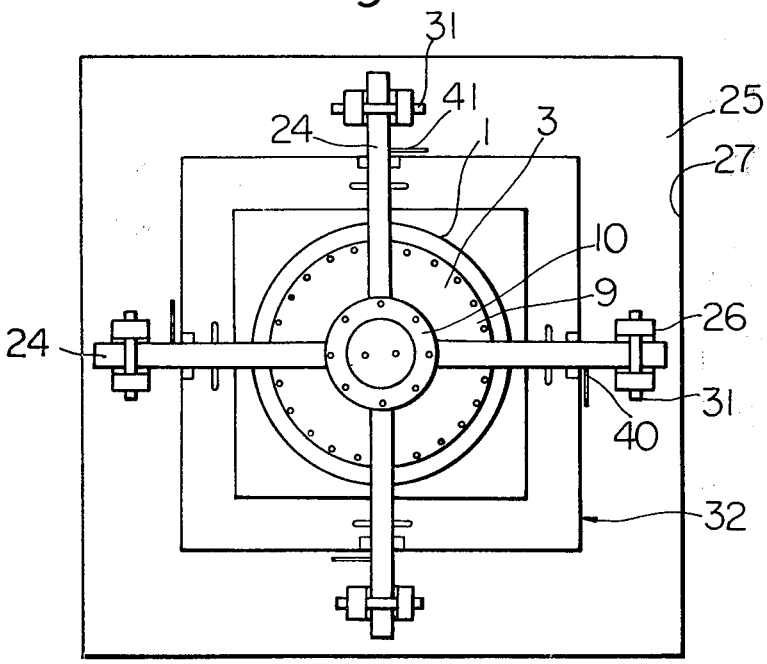
FIG. 2 is a plan view of FIG. 1.
Figure 3:
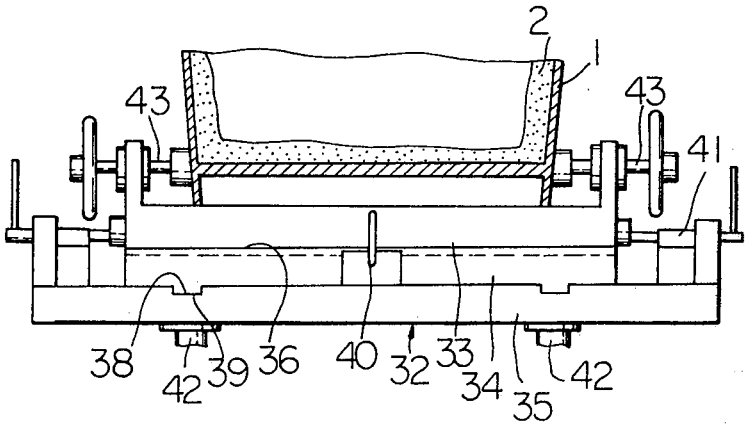
FIG. 3 is a partial enlarged view illustrating the bottom of the apparatus of FIG. 1.

The mechanism of positioning and fixing the molding box 3 inside the container 1 is described below. A molding box supporting member 24 is mounted above the molding box 3. This member 24 as noted, has four supporting arms which are set at four places as shown in FIG. 2.

A base 25 is provided so as to mount the container 1. The base 25 also mounts the same number of supports 26 as that of the molding box supporting member 24 and a position adjustment stand unit 32.

It is preferable to place the base 25 inside the pit 27.

A recessed portion 28 is provided on the upper end of the support 26, on which the molding box supporting arms are rested via a vibration proof packing 29 so as to sustain the molding box 3. On the upper end of the support 26, a cotter or like pin 31 is received through a cotter hole 30 so that the molding box supporting member 24 can be fixed inside the recess 28. Alternatively, an oil cylinder may be used instead of the cotter pin so as to fix the member 24.

The position adjustment stand 32 unit has mounted thereon a sliding stand 33 capable of moving horizontally, a sliding stand 34 below stand 33 and capable of moving horizontally and a bottom stand 35. Each of these stands 33, 34 and 35 has projected parts 37, 39 and recessed grooves 36, 38 engaged with each other. When the adjacent stand unit 32 is to be used for the containers 1 having various sizes, its structure is capable of moving vertically as a unit as described below.

The horizontal movement, back and fore, right and of stands 33 and 34, can be effected by the use of oil jacks 40, 41 mounted on the stand 35. As those skilled in the art will discern, the arrangement of stands 33, 34 is such as to permit two-dimensional horizontal positioning of the container 1 relative to the molding box 3. The vertical movement of the entire unit can be effected by means of the oil cylinders 42. The container 1 to be lined rested on the stand 32 can be pinched and fixed with the screw shaft mounted on the stand 33.

The container 1 to be lined is mounted on the center of the stand 32, then fixed by means of the screw shaft 42. The molding box 3 is then inserted into said container 1 and the arms of molding box supporting member 24 is mounted on the upper ends of the supports 26, which are then fixed by the cotter 31.

The relative position in the horizontal direction between the container 1 and the molding box 3 is adjusted by the operation of oil jacks 40 and 41.

The relative position in the vertical direction therebetween can be adjusted, if necessary, by the operation of the oil cylinder 42.

After the above mentioned operation, the fluidized material is caused to flow from the bottom of the molding box 3 and fill the gap 4.

In the apparatus of this invention, the mechanism of adjusting the relative position of the molding box and the container and the mechanism of fixing the same can be made so simple that the apparatus may be rigid and durable and the operation may be made simple.

The material can preferably be degassed and pressurized in this invention, so that the gap 4 is tightly filled with the material and the uniform and integral refractory lining can easily be obtained.

Furthermore, since the material is filled in the gap upwardly so that the air in the gap, if any, can easily be driven away, leaving no bubbles in the product lining.

An example of this invention in comparison with the prior art is shown below using a ladle as the container and using the apparatus shown in the drawing above.

Example

| | Ladle for molten steel (100 t) | | | |
|---|---|---|---|---|
| | Vibration casting of this invention | | Brick laying method of the prior art | |
| Material | Pyrophyllite type | Zirconia type | Pyrophyllite type | Zirconia type |
| Composition (%) | | | | |
| $SiO_2$ | 70~80 | 50~60 | 70~80 | 50~60 |
| $Al_2O_3$ | 10~20 | 10~20 | 10~20 | 5~10 |
| $ZrO_2$ | — | 20~30 | — | 30~40 |
| Water glass | about 5 | about 5 | — | — |
| Particle size (%) | | | | |
| >1 mm | 50~60 | 20~30 | — | — |
| 1 to 0.3 mm | 10~20 | 10~20 | — | — |
| <0.3 mm | 20~30 | 50~60 | — | — |
| Water added (%) | 6~7 | 5~6 | — | — |
| Apparent porosity (%) | lining porosity 10~20 | | brick porosity 10~18 | |
| Vibration time | | | | |

Example-continued

| Ladle for molten steel (100 t) | | | | |
|---|---|---|---|---|
| | Vibration casting of this invention | | Brick laying method of the prior art | |
| Material | Pyrophyllite type | Zirconia type | Pyrophyllite type | Zirconia type |
| (minute) Lining time (hour) | 20~30 casting & molding time 0.5~1 | | — brick laying time 10 | |

We claim:

1. Apparatus for applying a refractory lining to the inner wall surfaces of a container which is open at the top and is used for holding molten metal, said apparatus comprising a stand unit on which said container can be received, a molding box including:

a bottom wall, space encircling side wall structure extending upwardly from said base, said bottom wall having passage means extending therethrough, said bottom wall and side wall structure defining an upright open top housing, means for covering the top of said housing, means for suspending said housing disposed within said container with the outer surface of said bottom wall and side wall structure spaced from the inner wall surface of said container, means for vertically and two-dimensionally horizontally adjustably positioning said stand unit whereby the positioning of said molding box housing relative to said container can be correspondingly altered, said molding box further including, a closed vessel for holding refractory material which can be vibrated and given thixotropic fluidity extending upwardly from said bottom wall and disposed thereon centrally relatively of said side wall structure, means for selectively establishing communication between the interior of said closed vessel and the passage means in said bottom wall whereby refractory material present in said vessel can be conveyed therefrom through said passage means and into said container, and means for vibrating refractory material received in said vessel, said closed vessel having a lid at the top thereof, said lid carrying exhaust pipe means with which the interior of said vessel can be communicated with a source of vacuum for degassing refractory material therein, and pressure pipe means with which the interior of said vessel can be connected with a source of compressed gas to facilitate conveying said refractory material from said vessel into said container.

2. The apparatus of claim 1 in which the means for suspending said molding box housing within said container comprises a supporting member fixed to the top of said molding box and having arms extending laterally of said molding box, and uprights extending upwardly from locations adjacent said stand unit, said arms being connected with said uprights.

3. The apparatus of claim 1 in which said stand unit comprises a base stand, a first sliding stand on top of said base stand and slidable horizontally of said base stand in each of two opposite directions, a second sliding stand on top of said first sliding stand and slidable horizontally relatively of said first sliding stand in each of two opposite directions disposed at right angles to the sliding directions of said first sliding stand, and vertically displaceable cylinder means connected to said base stand, there being means on said second sliding stand for fixedly connecting said container thereto.

4. The apparatus of claim 1 in which said closed vessel has an opening in the bottom thereof communicating with said bottom wall passage means, the means for selectively establishing communication between the interior of said vessel and said passage means including a slidable closure member operable in a first position to intervene said opening and said passage means to prevent communication therebetween and in a second position to permit communication therebetween.

5. A molding box for applying a refractory lining to the inner wall surfaces of a container which is open at the top and is used for holding molten metal, said molding box comprising a bottom wall, space encircling side wall structure extending upwardy from said base, said bottom wall having passage means extending therethrough, said bottom wall and side wall structure defining an upright open top housing which can be disposed within said container with the bottom wall and side wall structures thereof spaced from the inner wall surface of said container and with said passage means in communication with the interior of said container, a closed vessel for holding refractory material which can be vibrated and given thixotropic fluidity extending upwardly from said bottom wall and disposed thereon centrally relatively of said side wall structure, means for selectively establishing communication between the interior of said closed vessel and the passage means in said bottom wall whereby refractory material present in said vessel can be conveyed therefrom through said passage means and into said container, means for covering the top of said housing, and means for vibrating refractory material received in said vessel, said closed vessel having a lid at the top thereof, said lid carrying exhaust pipe means with which the interior of said vessel can be communicated with a source of vacuum for degassing refractory material therein, and pressure pipe means with which the interior of said vessel can be connected into a source of compressed gas to facilitate conveying said refractory material from said vessel into said container.

* * * * *

UNITED STATES PATENT AND TRADEMARK OFFICE

CERTIFICATE OF CORRECTION

PATENT NO. : 3,944,193

DATED : March 16, 1976

INVENTOR(S) : Hiroyuki Imai; Rikuo Kaharu

It is certified that error appears in the above-identified patent and that said Letters Patent are hereby corrected as shown below:

At Col. 1, line 34, "like refractory material form" should read --like form--; line 36, "or the like having" should read --or like refractory material having--.

At Col. 2, lines 34-35, "member fixed indefinite refractory material, trunnion members fixed on said molding box," should read --member fixed on said molding box--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*